United States Patent [19]

Illos et al.

[11] 4,149,738

[45] Apr. 17, 1979

[54] TAMPER-PROOF PAGE ASSEMBLY

[75] Inventors: Bill Illos, Forest Hills, N.Y.; Robert D. Farkas, Westfield, N.J.

[73] Assignee: Milton Wilkow, Plainfield, N.J.

[21] Appl. No.: 839,421

[22] Filed: Oct. 5, 1977

[51] Int. Cl.[2] ..... B42B 5/04

[52] U.S. Cl. ..... 283/8 B; 283/9 R; 402/13; 428/460; 40/2.2

[58] Field of Search ..... 283/8 R, 8 B, 9 R, 9 A, 283/8 A, 7, 11, 17, 6, 63; 281/18, 15; 402/18, 8, 4, 13, 79; 428/460, 524; 116/119; 40/2.2

[56] References Cited

U.S. PATENT DOCUMENTS

| | | | |
|---|---|---|---|
| 1,013,125 | 1/1912 | Campbell | 402/13 |
| 1,446,408 | 2/1923 | Adams | 402/13 |
| 2,283,898 | 5/1942 | Arico | 283/7 |
| 2,382,828 | 8/1945 | Staneslow | 283/8 R |
| 3,088,841 | 5/1963 | Guertin | 283/8 R |
| 3,204,354 | 9/1965 | Berger | 283/8 R |
| 3,340,137 | 9/1967 | Kamal | 428/460 |
| 3,457,661 | 7/1969 | Peters | 40/2.2 |
| 3,511,748 | 5/1970 | Heeb et al. | 428/460 |
| 4,051,295 | 9/1977 | Bernstein | 283/8 B |
| 4,101,701 | 7/1978 | Gordon | 40/2.2 |

FOREIGN PATENT DOCUMENTS

| | | | |
|---|---|---|---|
| 967735 | 8/1964 | United Kingdom | 283/8 R |

*Primary Examiner*—Leonidas Vlachos
*Attorney, Agent, or Firm*—Robert D. Farkas

[57] ABSTRACT

A tamper-proof page assembly utilizes a ribbon to string the assembly together by passing the ribbon through holes in the pages of the assembly. The ends of the ribbon are sealed to a cover page thereof with a thermosetting plastic slug. Removal of the slug leaves tell-tale marks on, or destroys the integrity of, the surface of the cover page to which it is adhered. The ribbon material is chosen such that it melts or disintegrates immediately above the chosen curing or setting temperature of the slug. Attempting to tamper with the seal by heating the slug above the curing temperature destroys the ribbon and additionally causes an increase in the mechanical hardness of the slug. Additional tamper detecting apparatuses include sequential numbers on pages, soluble indicia patterns on the pages for use with an ink pen containing an appropriate solvent, laminated pages, and pages having polished surfaces. The page assembly can be clipped into a ring binder when the pages are loosely strung together by the ribbon.

28 Claims, 10 Drawing Figures

TAMPER-PROOF PAGE ASSEMBLY

BACKGROUND OF THE INVENTION

1. The Field of the Invention

This invention relates to book bindings and more particularly to that class adapted to provide security against tampering by threading the pages together with a ribbon and sealing the ribbon ends together to a cover page of the book.

2. Description of the Prior Art

The prior art abounds with disclosures of document security systems employing pages linked by a threading ribbon with the ends of the ribbon sealed together. Original United States patents are currently sealed by this method, employing a foil seal applied with glue. A simple dangling seal system employing lead for the seal material and a wire to bind the pages together, or alternatively a wax seal securing the ends of a threading cord are disclosed by U.S. Pat. No. 593,125, issued to A. Rosedale on Nov. 2, 1897 entitled "Mileage Book and Coupon Ticket Protector." A similar lead seal and wire security system for a block or stack of lottery tickets is disclosed by U.S. Pat. No. 3,307,858, issued to S. Sanden on Mar. 7, 1967. U.S. Pat. No. 2,283,898, issued to S. Arico on May 26, 1942, discloses a similar sealing system employing a threaded cord with the ends sealed down to a page by means of sealing wax. U.S. Pat. No. 2,832,307, issued to J. Cavallero on Apr. 29, 1958, discloses the use of thermosetting plastic to bond together the ends of a group of ribbon book markers for removable placement in between the leaves of a book. This patent, however, neither discloses nor claims use of thermosetting plastic as an adjunct to ribbon sealed document security systems, or as a means of sealing a single ribbon into a closed loop for permanent attachment to a book.

Seals made between adjacent layers of conventional materials are only a minor hindrance to determined efforts to separate them. Soft metal seals, such as the lead seal employed in conjunction with a wire, are easily pried away from the wire, whereupon the documents bound thereby are vulnerable to unauthorized page replacement, after which the soft metal seal may once again be crimped together over the ends of the wire. Thermoplastic materials, such as some types of wax, form equally vulnerable seals in that such seals can be easily melted and lifted, typically with a hot knife, the resealing being subsequently accomplished by a simple undetectable reheating operation. The known art suffers from the lack of a seal material that discourages attempts to tamper with the sealed documents by undergoing irreversible changes in its mechanical properties resulting from efforts to open or "lift" the sealed materials, and whose mechanical condition and physical appearance are difficult to reproduce if the seal is deliberately or accidentally broken in the tampering process.

SUMMARY OF THE INVENTION

A primary object of the present invention is to provide a ribbon sealing method for bound pages that is highly resistant to tampering, particularly to tampering methods employing heat.

Another object of the present invention is to provide a method so designed as to later disclose earlier attempts at tampering when heat was employed to tamper.

Still another object of the present invention is to provide devices for detecting the removal or alteration of pages by those means not involving breaking the integrity of the seal itself or the ribbon used to string the pages together.

Yet another object of the present invention is to provide a book assembly which prevents the unauthorized substitution of pages of the assembly with other pages, or which indicates the modification of indicia disposed on the original pages of the assembly.

The present invention utilizes the adhesion and curing properties of thermosetting plastics. Such plastics are cured from a resinous state to a hard and brittle nonmeltable state by heating the plastic to an appropriate curing or cross-linking temperature. An adequate curing process is characterized by a range of proper curing temperatures, the lowest temperature of this range signifying the onset of curing, or cross-linking, and the highest temperature signifying complete curing and maximum mechanical hardness of the thermosetting material. Such material when cured at a temperature at or slightly above the above described lower curing temperature is relatively soft and more often than not, pliable. The degree of mechanical hardness achieved by a given thermosetting plastic is governed by the maximum curing temperature employed; curing at a temperature intermediate the two temperature extremes results in a mechanical hardness uniquely characteristic of any particular curing temperature used. Thus, for any sample of a given thermosetting plastic one can easily determine the maximum temperature experienced by the sample in the past simply by measuring its mechanical hardness properties. In short, hardness properties are a guide to the past thermal experience of the thermosetting plastic.

It is therefore, one of the features of this invention to fabricate the seal from a sheet of thermosetting plastic such as melamine-formaldehyde resin in the form of a disc-shaped slug or sheet-like plate, the plate typically consisting of woven filaments of glass or plastic impregnated with an uncured resinous thermosetting plastic material. The slug is placed over portions of the ribbon adjacent the ribbon ends and then pressed against the top sheet of the stack of a page assembly. The slug is next subjected to a temperature somewhere in the thermosetting plastic material's curing range, whereupon the resin contacting the ribbon forms a strong bond to it and the top sheet of the assembly, resulting in the formation of a hard brittle seal, bonding the ribbon portions to the top sheet and to the slug. For security purposes one measures and records the hardness of the cured seal slug. Subsequent attempts to tamper with the seal by attempting to melt it at temperatures above the curing temperature will result in a measurable increase in the hardness of the seal or ultimately in the disintegration of the seal if sufficiently high temperatures are attained. Additional security measures applied to such a seal include embossing or debossing suitable indicia on the seal, and the use of an overlay embossed or debossed metal-like foil adhering to the top surface of the seal, or if desired, partially adhering to the top sheet.

Additionally, proper choice of ribbon materials may be used to insure that the ribbon melts or disintegrates at a temperature just above the chosen curing temperature, with the result that the ribbon is destroyed if attempts are made to melt or otherwise heat the seal. Such a ribbon may be made of unique design, not easily duplicated, typically by use of indicia disposed on or in the ribbon.

It is important that the portions of the ribbon covered by the slug be visible, so that a break or a cut in the ribbon cannot be hidden from view. To achieve this the slug may be made transparent by using a clear thermosetting plastic of approximately the same index of refraction as the woven filaments of the slug. Alternatively, the cover page to which the slug is affixed may be made of transparent or translucent material.

Individual page security apparatuses include indicia used to number the pages sequentially to detect removal of one or more pages. Additional apparatuses are utilized to guard against alteration of entries by means of erasure or chemical bleaching. Pages made of surface polished paper readily show attempts at erasure by a characteristic loss of gloss in the erased portions. Laminated security paper pages wherein a fragile thin surface layer overlies a heavier substrate paper of a different color have the property that attempts at erasure destroy the top layer by abrasion and expose the substrate layer, giving rise to a visible difference in color in the abraded areas.

Additionally, ordinary graph paper pages serve as security paper against erasures and bleaches, since such removal procedures remove the security indicia along with the written entries during such tampering. The obliteration of such indicia thus constitutes evidence of attempts at alteration of entries. A more advanced type of security indicia system is also proposed, wherein specially soluble colored security indicia are printed on the pages. Legitimate written entries on such pages are made in ink containing an appropriate solvent for the soluble indicia. During the brief period while this ink is drying on the paper the underlying indicia are locally dissolved, with the result that they spread lengthwise along the line of the wet ink. Thus under each ink line there lies a parallel colored line segment wherever the ink line crosses an indicia line. The use of selective bleaches which attack and remove entry inks without attacking the inks comprising security indicia is a customary technique of skilled document forgers. This technique, however, cannot succeed if the soluble indicia system is used, since selective removal of the entry ink reveals the local distortion in the underlying security indicia.

Binding the page assembly with a suitable amount of slack in the ribbon allows the stack to be mounted in loose leaf fashion between the covers of a ring binder, thereby preserving the ribbons and seals intact. Alternatively, heavy cover sheets may be employed at the top and bottom of the stack.

By employing the foregoing measures a significant increase in the security of bound page assemblies is achieved. The prior thermal history of the seal is built into the seal itself. Subsequent attempts to tamper by heating leave their own history in the seal as well, with the result that even unsuccessful attempts leaving no visible traces may often be detected. The use of additional ribbon and page security methods and apparatuses as previously described when used in conjunction with such a seal combine to make the problem of undetectably tampering with documents so sealed considerably more difficult than has hitherto been the case.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to ribbon-bound sealed notebooks.

Figure 1:
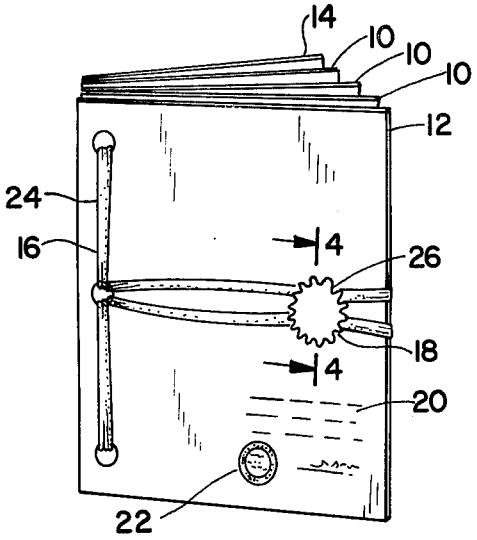
FIG. 1 shows a front elevation view of a ribbon-bound sealed notebook.

Now referring to the figures, and more particularly to the embodiment illustrated in FIG. 1 showing the preferred embodiment comprising a stack of pages 10 held between top cover sheet 12 and bottom cover sheet 14 by ribbon 16 secured by seal 18, the seal securing the end portions of ribbon 16 to top cover sheet 12. Top cover sheet 12 additionally bears indicia 20 attesting to the act of sealing and notary seal 22 attesting the signature below said sealing attestation. Ribbon 16 bears woven-in unique indicia 24 making duplication of this ribbon difficult. Seal 18 is typically of thermosetting melamine-formaldehyde plastic or of a similar thermosetting material, said seal having been partially cured at a preselected temperature while held under pressure against the ribbon ends and top cover sheet 12. Use of an appropriate sealing die results in embossed or debossed indicia 26 on seal 18. Ribbon 16 is typically made of an acetate-like material, the curing temperature of seal 18 being adjusted to a value just below the melting temperature of ribbon 16. The mechanical hardness of the seal after curing is measured by conventional hardness measuring techniques. Subsequent heating above the curing temperature in an effort to tamper with the seal results in a readily measurable increase in seal hardness, as well as destruction of ribbon 16.

Figure 2:
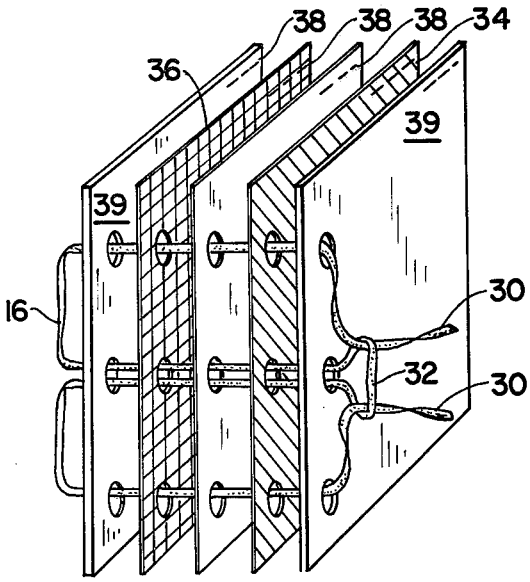
FIGS. 2 and 3 are perspective views showing alternative methods of looping the ribbon to thread the pages together.
Figure 3:
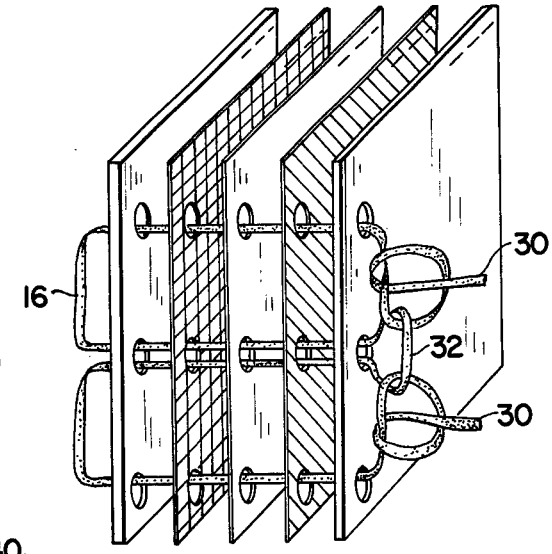

FIG. 2 shows the preferred three-hole method of stringing ribbon 16 through the pages of the stack. Ribbon ends 30 are passed through bight 32 before sealing. By leaving a slight amount of slack in ribbon 16 before sealing, the entire ribbon exterior to seal 18 may be examined for a resealed cut. An alternative stringing method is shown in FIG. 3, wherein ribbon 16 is knotted to both sides of the bight. This method is best suited to the binding of a massive number of pages because in such a case the weight of the pages themselves if threaded as in FIG. 2 could throw an unacceptable strain on the seal. The disadvantage of the knotted bight is that a knot can conceal a resealed cut in the ribbon.

Figure 4:
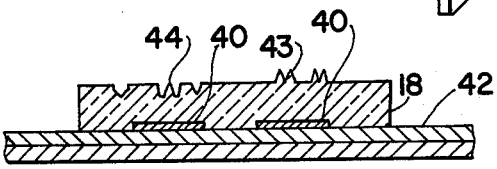
FIG. 4 shows a side elevation cross-sectional view of the segment of FIG. 1 indicated by line 4—4.

FIG. 4 shows seal 18 anchoring ribbon portions 40 to laminated page 42. Seal 18 in this version is transparent or translucent to allow inspection of the buried portions 40. Embossed indicia 43 debossed indicia 44 are portrayed on the top surface of seal 18.

Figure 5:
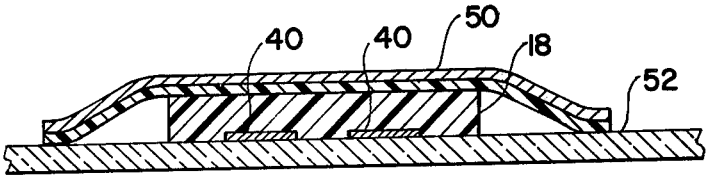
FIGS. 5 and 6 show variations on the scheme shown in FIG. 4.
Figure 6:
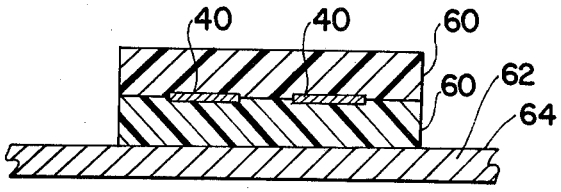

FIGS. 5 and 6 show alternative versions of the seal structure shown in FIG. 4. In FIG. 5 a metallized plastic foil 50 is affixed to the top of seal 18 and to transparent or translucent page 52. Seal indicia 26 shown in FIG. 1 are here presumed to be in printed rather than embossed form. FIG. 6 shows a seal wherein ribbon portions 40 are captured between two thermosetting seal slugs 60, whereby both surfaces of ribbon portions 40 are exposed to bonding material. This embodiment gives a stronger bond to non-porous or otherwise impermeable ribbons by adhesively bonding to both major surfaces of ribbon portions 40. The resulting composite seal structure is bonded to page 62, this page having a polished upper surface 64 to detect attempts at erasure.

Figure 7:
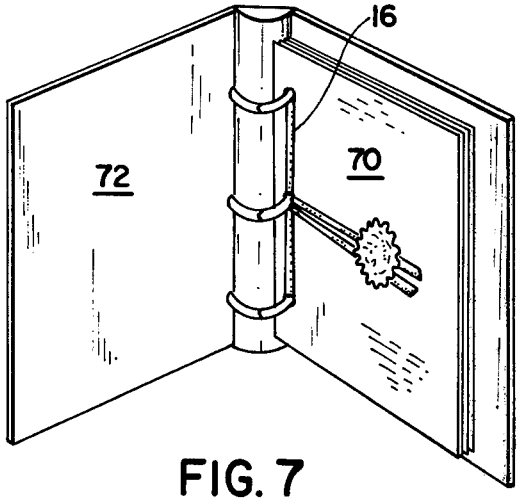
FIG. 7 shows a perspective view of a ribbon-sealed notebook in a ring binder.

FIG. 7 shows a bound and sealed notebook 70 held in loose-leaf ring binder 72. A sufficiently loose ribbon 16 allows the pages of notebook 70 to be turned at will. One thus has a loose-leaf notebook protected by a binder with the pages sealed together.

Figure 8:
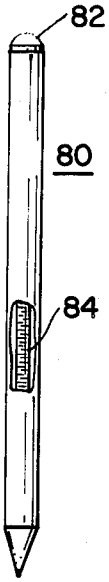
FIG. 8 shows a side elevation partially cross-sectional view of an ink pen with a removable filler cap.
Figure 9:
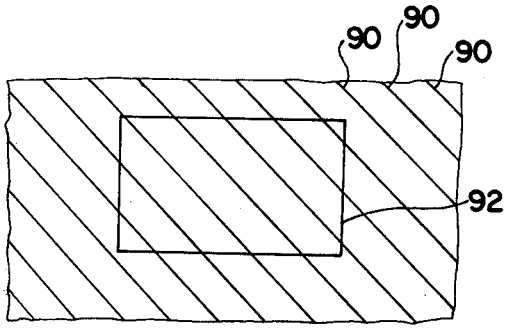
FIG. 9 is a front elevation view of a portion of a page protected by a diagonal array of lines printed in soluble ink, over which a rectangle has been drawn.
Figure 10:
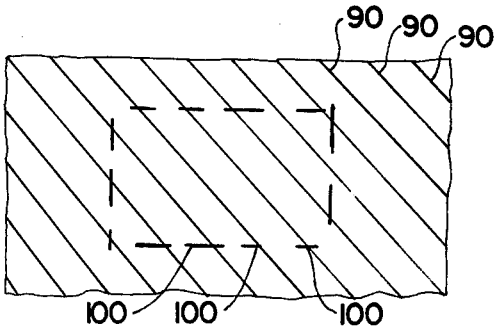
FIG. 10 shows the pattern remaining after the inked rectangle of FIG. 9 has been deleted by a selective bleach.

FIG. 8 shows a ball point ink pen 80 with filler cap 82. Ink supply 84 contains a solvent that dissolves diagonal security indicia 90 shown in FIG. 9. Drawing rectangle 92 with pen 80 causes the portions of indicia 90 underlying the lines comprising rectangle 92 to dissolve and spread. Attempting to tamper with the drawing by use of a selective bleach that attacks only the drawing ink thus causes the local spread of security indicia 90 to be revealed as shown by points 100 in FIG. 10.

FIG. 2 shows a page 34 bearing such soluble indicia. Additionally FIG. 2 shows the use of a graph paper page 36, whereby the crosshatched graphical indicia constitute a means of detecting the deletion of entries by erasure or bleaching. Indicia 38 number the pages, whereby the removal of pages from the stack may be detected. Thick flexible covers 39 protect the interior pages.

One of the advantages of the present invention is a ribbon sealing method for bound pages that is highly resistant to tampering, particularly to tampering methods employing heat.

Another advantage of the present invention is a method so designed as to later disclose earlier attempts at tampering when heat was employed to tamper.

Still another advantage of the present invention are devices for detecting the removal or alteration of pages by those means not involving breaking the integrity of the seal itself or the ribbon used to string the pages together.

Yet another advantage of the present invention is a book assembly which prevents the unauthorized substitution of pages of the assembly with other pages, or which indicates the modification of indicia disposed on the original pages of the assembly.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiments of the invention in which an exclusive privilege or property is claimed are defined as follows:

1. A bound booklet comprising a plurality of paper-like sheets, each sheet of said plurality of sheets having at least one hole therein, said plurality of sheets being disposed in stacked overlying relationship such that said at least one hole in said each sheet is aligned with said at lease one hole of the remaining sheets of said plurality of sheets, said plurality of sheets having a topmost sheet and a lowermost sheet, an elongated flexible ribbon, said ribbon having a first portion and a pair of second portions and a third portion and a pair of fourth portions disposed along the length thereof, said first portion of said ribbon passing through said at least one hole in said each sheet, said ribbon having a pair of ends, said pair of ends of said ribbon being disposed over said topmost sheet of said plurality of sheets, a thermosetting plastic sheet, said thermosetting plastic sheet being disposed bonded to said pair of second portions of said ribbon, said pair of second portions of said ribbon being located adjacent said pair of ends thereof, a portion of said thermosetting sheet being disposed bonded to the outermost surface of said topmost sheet whereby said plurality of sheets are permanently bound together by said ribbon.

2. The apparatus as claimed in claim 1 further comprising said each sheet having three holes therein, said ribbon being disposed passing through each of said three holes, said three holes being disposed in spaced apart relationship along a line, said line being disposed adjacent and parallel to a marginal edge of said each sheet.

3. The apparatus as claimed in claim 2 further comprising said third portion of said ribbon including a bight, said bight passing through said lowermost sheet and emerging outwardly from said topmost sheet passing through one of said three holes of said each sheet, said pair of fourth portions of said ribbon being disposed adjacent said bight and being disposed in overlying relationship with said lowermost sheet, said pair of fourth portions being disposed passing through the other two of said three holes of said each sheet, the remaining pair of portions of said ribbon being disposed passing through said bight and in overlying relationship with said topmost sheet.

4. The apparatus as claimed in claim 3 wherein said remaining pair of portions of said ribbon are knotted to said bight.

5. The apparatus as claimed in claim 1 wherein said pair of second portions of said ribbon are disposed in side by side relationship intermediate said thermosetting sheet and said topmost sheet.

6. The apparatus as claimed in claim 1 further comprising a metallic-like sheet, said metallic-like sheet being disposed fixedly secured to the uppermost surface of said thermosetting sheet.

7. The apparatus as claimed in claim 6 wherein said metallic-like sheet comprises a metallized plastic material.

8. The apparatus as claimed in claim 6 further comprising the uppermost surface of said metallic-like sheet carrying indicia thereon.

9. The apparatus as claimed in claim 6 wherein said metallic-like sheet has the marginal edges thereof disposed extending outwardly from the marginal edges of said thermosetting sheet.

10. The apparatus as claimed in claim 6 wherein portions of said metallic-like sheet are disposed fixedly secured to said topmost sheet.

11. The apparatus as claimed in claim 1 further comprising the uppermost surface of said thermosetting sheet being embossed with indicia.

12. The apparatus as claimed in claim 1 further comprising the uppermost surface of said thermosetting sheet being debossed depicting indicia thereby.

13. The apparatus as claimed in claim 1 wherein said topmost sheet carries indicia.

14. The apparatus as claimed in claim 1 wherein a plurality of said plurality of sheets carry indicia representing a plurality of sequential numbers thereon.

15. The apparatus as claimed in claim 1 wherein said thermosetting sheets are fabricated from a transparent material.

16. The apparatus as claimed in claim 1 wherein said topmost sheet is fabricated from a transparent material.

17. The apparatus as claimed in claim 1 wherein said ribbon comprises an acetate-like material.

18. The apparatus as claimed in claim 1 wherein at least one sheet of said plurality of sheets has indicia thereon representing graph paper.

19. The apparatus as claimed in claim 1 wherein at least one sheet of said plurality of sheets comprises at least one lateral surface thereof being polished.

20. The apparatus as claimed in claim 1 further comprising a loose-leaf binder, said loose-leaf binder having at least one prong fastener, said plurality of sheets being removably clamped within said prong fastener of said binder by having said prong fastener pass through said at least one hole of said each sheet.

21. The apparatus as claimed in claim 1 further comprising said topmost sheet carrying indicia representing a notary seal.

22. The apparatus as claimed in claim 1 further comprising said thermosetting sheet being translucent.

23. The apparatus as claimed in claim 1 wherein said thermosetting sheet is disposed in a substantially irreversible thermoset condition when heated to a temperature below the melting temperature of said ribbon.

24. The apparatus as claimed in claim 1 further comprising said ribbon carrying a pattern of indicia, said pattern being disposed on at least one major surface of said ribbon.

25. The apparatus as claimed in claim 1 wherein said topmost sheet and said lowermost sheet of said plurality of sheets have thicknesses greater than the thickness of the remaining sheets of said plurality of sheets.

26. The apparatus as claimed in claim 1 further comprising at least one sheet of said plurality of sheets carrying a pattern of indicia disposed on at least one lateral surface thereof, said pattern of indicia being fabricated having a color different from the color of said at least one lateral surface, said pattern of indicia being dissolvable upon the application of a solvent to a portion of said pattern of indicia.

27. The apparatus as claimed in claim 26 further comprising a writing instrument, said writing instrument carrying an ink-like material, said ink-like material being mixed with a quantity of said solvent.

28. The apparatus as claimed in claim 1 further comprising at least one sheet of said plurality of sheets having at least two laminated layers of paper-like material, at least one outer layer having a lesser thickness than the adjacent layer, the lateral surface of said adjacent layer being colored differently than said at least one outer layer.

* * * * *